United States Patent [19]

Nakamura et al.

[11] 3,980,832

[45] Sept. 14, 1976

[54] DECODER FOR FOUR CHANNEL FM STEREOPHONIC COMPOSITE SIGNAL HAVING AN INDICATING SIGNAL WHEREIN THE INDICATING SIGNAL IS DETECTED AND USED IN THE DECODING OF THE FOUR CHANNEL COMPOSITE SIGNAL

[75] Inventors: Hideo Nakamura, Komae; Teruo Sato, Yamato, both of Japan

[73] Assignee: Sony Corporation, Tokyo, Japan

[22] Filed: Feb. 21, 1975

[21] Appl. No.: 551,705

[30] Foreign Application Priority Data

Feb. 25, 1974 Japan ..... 49-22145

[52] U.S. Cl. ..... 179/15 BT; 325/455

[51] Int. Cl.[2] ..... H04H 5/00

[58] Field of Search .... 179/15 BT, 1 GQ, 100.4 ST, 179/100.1 TD; 325/36, 47, 455

[56] References Cited

UNITED STATES PATENTS

| | | | |
|---|---|---|---|
| 3,534,172 | 10/1970 | Weeda | 179/15 BT |
| 3,708,623 | 1/1973 | Dorren | 179/15 BT |
| 3,714,595 | 1/1973 | Denenberg et al. | 179/15 BT |
| 3,787,629 | 1/1974 | Limberg | 179/15 BT |
| 3,896,272 | 7/1975 | Takahashi et al. | 179/15 BT |

*Primary Examiner*—Douglas W. Olms
*Attorney, Agent, or Firm*—Lewis H. Eslinger; Alvin Sinderbrand

[57] ABSTRACT

A decoder is provided for four channel FM stereophonic composite signals including a first pilot signal, a main channel signal, a first sub-channel signal suppressed carrier amplitude modulated on a first subcarrier having a frequency twice that of the first pilot signal, a second sub-channel signal suppressed carrier amplitude modulated on a second subcarrier having the same frequency as the first subcarrier and having 90° phase difference with respect to the first subcarrier, a third subchannel signal suppressed carrier amplitude modulated on a third subcarrier having a frequency twice that of the first subcarrier, and a second pilot signal indicative of the four channel stereophonic signal broadcasting mode and with a frequency interposed between the frequency bands of the first and third subcarriers; which decoder comprises a control signal generator controlled by the first pilot signal and producing first and second control signals in predetermined phase relation to the first pilot signal and with frequencies that are respectively equal to, and twice the frequency of the first pilot signal, a signal combining circuit supplied with the first and second control signals for producing a switching signal, and a switching circuit controlled by the switching signal for detecting the second pilot signal in the four channel FM stereophonic composite signals. When the second pilot signal is thus detected, signals from the control signal generator are employed for demodulating the four channel FM stereophonic composite signals into the corresponding four discrete audio signals; whereas, when the second pilot signal is not detected, for example, in the case of the reception of two channel stereophonic broadcast transmission, the aforesaid second control signal is employed for demodulating the two channel FM stereophonic composite signals into the two corresponding discrete audio signals.

8 Claims, 6 Drawing Figures

Fig. 1
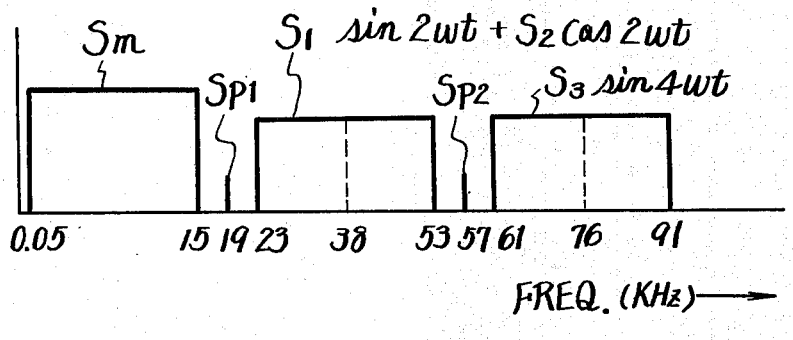
Fig. 3A
Fig. 3B
Fig. 3C
Fig. 3D
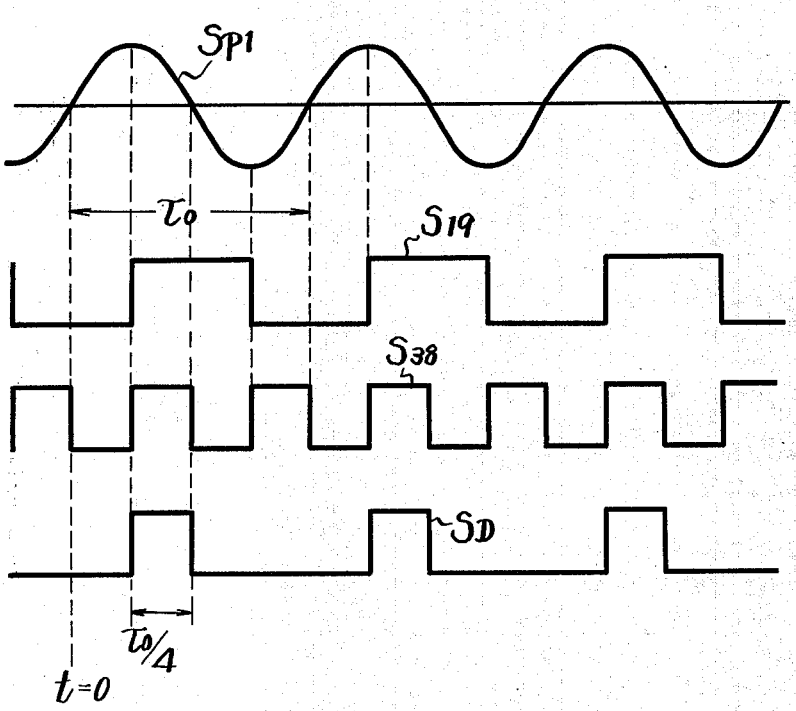

DECODER FOR FOUR CHANNEL FM STEREOPHONIC COMPOSITE SIGNAL HAVING AN INDICATING SIGNAL WHEREIN THE INDICATING SIGNAL IS DETECTED AND USED IN THE DECODING OF THE FOUR CHANNEL COMPOSITE SIGNAL

BACKGROUND OF THE INVENTION

1. Field of the Invention

This invention relates generally to a decoder for four channel FM stereophonic composite signals, and more particularly to a decoder for four channel FM stereophonic composite signals in which a signal indicative of the four channel stereophonic signal broadcasting mode is detected.

2. Description of the Prior Art

In U.S. Pat. No. 3,708,623 there is disclosed a four channel FM stereophonic transmitting system which is compatible with two channel stereophonic signal broadcasting and monaural broadcasting. With this system, it is necessary to switch the receiving condition of the receiver so as to adapt the same for four channel stereophonic broadcasting or two channel stereophonic broadcast reception. In general, a signal which is broadcast only in the four channel stereophonic broadcasting mode is detected for switching the receiver to the receiving condition suitable for four channel or two channel stereophonic broadcast reception.

Further, in U.S. Pat. No. 3,787,629, relating to "Apparatus for Distinguishing Between FM Broadcast Multiplex Transmission", it is proposed to distinguish between four channel and two channel stereophonic broadcast transmissions by detecting, in the four channel stereophonic broadcast transmission, a second sub-channel signal modulated on a second subcarrier which has a frequency twice that of a pilot signal and a phase difference of 90° in respect to the latter, and which is not present in two channel stereophonic broadcast transmissions. Alternatively, this patent suggests that the four channel stereophonic broadcast transmissions may be distinguished by detecting therein a third sub-channel signal modulated on a third subcarrier having a frequency four times that of the pilot signal. However, since the level of the above mentioned second sub-channel signal or third sub-channel signal will vary, the detecting level will similarly fluctuate so that the detection or distinguishing of the four channel stereophonic broadcast transmissions from the two channel stereophonic broadcast transmissions cannot be reliably and stably achieved. Further, if the second or third subcarrier is of the suppressed carrier type, so that, as has been proposed, the four channel stereophonic broadcasting mode can be detected by suitably selecting the suppressed level, complicated detecting circuits are required for that detecting function.

It has also been proposed to provide a second pilot signal with a frequency three times that of a 19KHz first pilot signal in a frequency gap between the first sub-channel and the third sub-channel. In this case, the four channel composite signal is applied to a phase locked loop (PLL) or a band pass filter to detect whether or not the second pilot signal exists and to determine whether or not a four channel stereophonic broadcast transmission is present on the basis of the detected signal. Further, in this latter proposal, the demodulated signal is applied to a second PLL or band pass filter to pick up the first pilot signal and discrete left front, left back, right front and right back audio signals are demodulated from the four channel stereophonic composite signal upon the reception of the latter. However, since a PLL or band pass filter is required to produce the first pilot signal and a separate or additional PLL or band pass filter is required to produce the second pilot signal, this last described proposal involves the use of an undesirably complicated circuit arrangement. Further, if the second pilot signal is produced by a band pass filter rather than a PLL with a view to relatively reducing the cost, such band pass filter must have rather sharp characteristics and, after assembly of the circuit, the same must be adjusted and care must be exercised to accommodate changes in its time constant and temperature.

OBJECTS AND SUMMARY OF THE INVENTION

Accordingly, it is an object of the present invention to provide a decoder for four channel FM stereophonic composite signals which is free of the above defects.

Another object is to provide a decoder for four channel FM stereophonic composite signals in which a second pilot signal with a frequency three times that of a first pilot signal is used for identification of four channel stereophonic broadcast transmissions and for distinguishing the latter from two channel stereophonic broadcast transmissions and a simple circuit is used for detection of the second pilot signal.

A further object is to provide a decoder for four channel FM stereophonic composite signals in which a detecting circuit for the second pilot signal consists of a circuit for detecting the first pilot signal and a circuit for detecting a signal with a frequency twice that of the first pilot signal and which is used for the demodulation of the four channel FM stereophonic composite signals.

It is still another objcet of the invention to provide a decoder for four channel FM stereophonic composite signals in which an output from a detecting circuit for the second pilot signal is used to switch the condition of the decoder from that for four channel stereophonic broadcasting and for two channel stereophonic broadcasting and further to provide an indication of the existing condition.

In accordance with an aspect of this invention, there is provided a decoder for four channel FM stereophonic composite signals including a first pilot signal, a main channel signal, a first sub-channel signal which is suppressed carrier amplitude modulated on a first subcarrier having a frequency twice that of the first pilot signal, a second sub-channel signal which is suppressed carrier amplitude modulated on a second subcarrier having the same frequency as the first subcarrier and having 90° phase difference with respect to the first subcarrier, a third sub-channel signal which is suppressed carrier amplitude modulated on a third subcarrier having a frequency twice that of the first subcarrier, and a second pilot signal indicative of the four channel stereophonic signal broadcasting mode and having a frequency three times that of the first pilot signal; which decoder comprises means for detecting the first pilot signal and for producing first and second control signals in predetermined phase relation to said first pilot signal and respectively having frequencies that are equal to the frequency of said first pilot signal and twice said frequency of the first pilot signal, means for combining said first and second control signals to provide a switching signal, and switching means operable by said switching signal for detecting said second pilot signal in the four channel FM stereophonic composite signals.

The above, and other objects, features and advantages of the invention, will become apparent in the following detailed description of an illustrative embodiment which is to be read in conjunction with the accompanying drawings.

BRIEF DESCRIPTION OF THE DRAWINGS

FIG. 1 is a frequency spectrum diagram of four channel FM stereophonic composite signals which may be decoded by a decoder according to the invention;

FIGS. 3A to 3D, inclusive, are waveform diagrams to which reference will be made in explaining the operation of the decoder of FIG. 2.

DESCRIPTION OF THE PREFERRED EMBODIMENT

Figure 2:
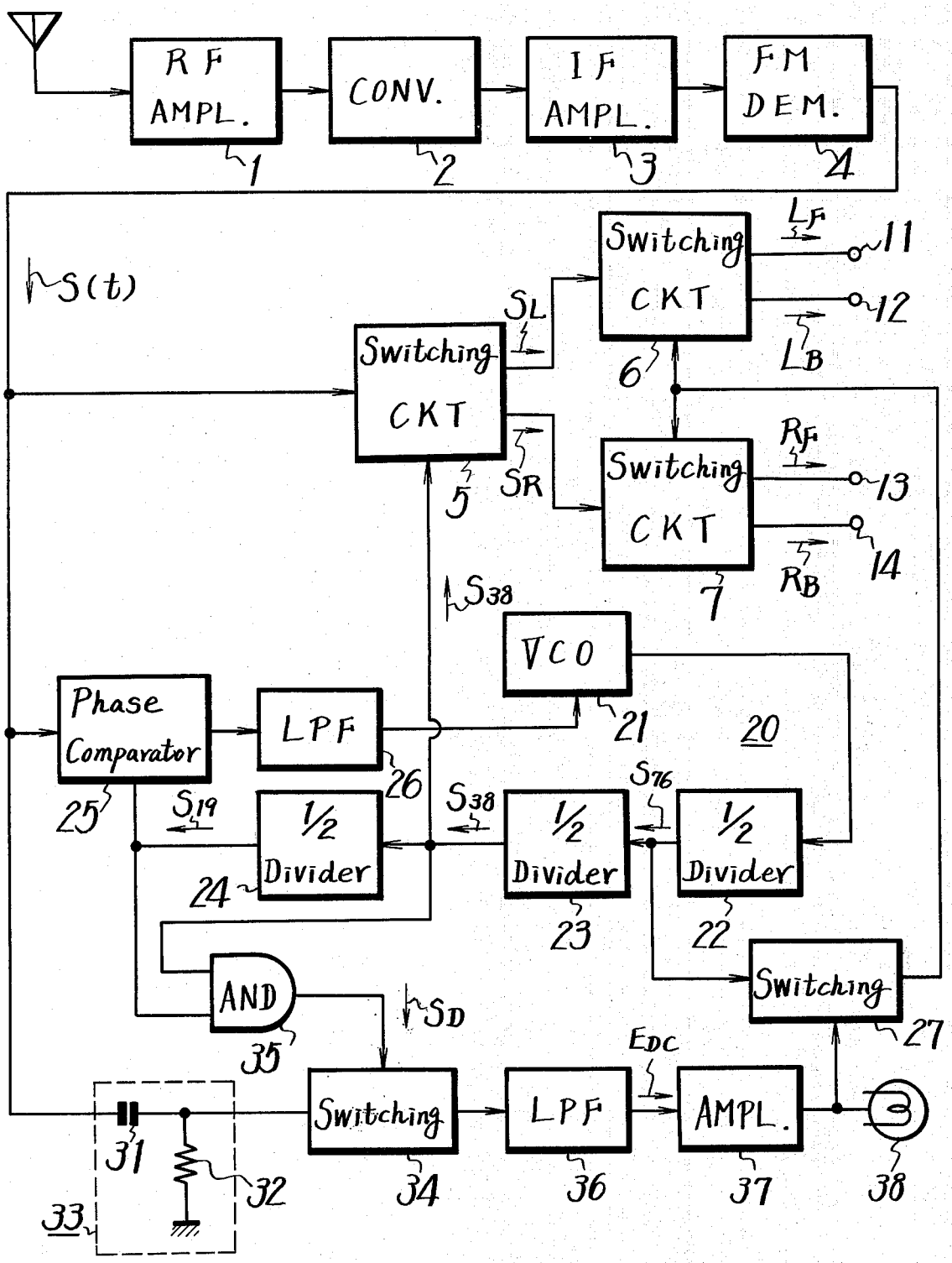
FIG. 2 is a schematic block diagram showing an embodiment of a decoder according to this invention.

Referring to the drawings in detail, and initially to FIG. 1 thereof which shows the frequency spectrum of the four channel FM stereophonic composite signals $S(t)$ which are to be decoded by the decoder of the invention, it will be seen that these signals $S(t)$ may be expressed as follows:

$$S(t) = S_m + S_1 \sin 2\omega t + S_2 \cos 2\omega t + S_3 \sin 4\omega t + P_1 \sin \omega t + P_2 \sin 3\omega t \quad (1)$$

in which:

$S_m = (L_F + L_B) + (R_F + R_B)$
$S_1 = (L_F + L_B) - (R_F + R_B)$
$S_2 = (L_F - L_B) \pm (R_F - R_B)$
$S_3 = (L_F - L_B) \pm (R_F - R_B)$
$\omega = 2\pi f, f = 19$ KHz
$P_1 \sin \omega t$ is a first pilot signal
$P_2 \sin 3\omega t$ is a second pilot signal
$L_F$ is a left front audio signal
$L_B$ is a left back audio signal
$R_F$ is a right front audio signal
$R_B$ is a right back audio signal As shown in the frequency spectrum of FIG. 1, the composite main channel signal $S_m$ in equation (1) is located within the main channel of 0.05 to 15 KHz, and the composite signal $S_1$ is a first sub-channel signal which is suppressed carrier amplitude modulated on a first subcarrier with a frequency of 38 KHz, that is, twice that of the first pilot signal. The composite signal $S_2$ is a second sub-channel signal which is suppressed carrier amplitude modulated on a second subcarrier which has the same frequency as, and 90° phase difference from the first subcarrier, and the composite signal $S_3$ is a third sub-channel signal which is suppressed carrier amplitude modulated on a third subcarrier with a frequency of 76 KHz, that is, twice that of the first subcarrier or four times that of the first pilot signal. The first pilot signal $S_{p1}$, which is indicative of the two channel stereophonic broadcasting mode, is located within a frequency band between the main channel and the lowest side of the first subcarrier, and the composite signal $S(t)$ further includes a second pilot signal $S_{p2}$, which is indicative of the four channel stereophonic broadcasting mode, and which is located within a frequency band between the highest side of the first subcarrier and the lowest side of the third subcarrier.

In the composite signal $S(t)$ of equation (1), the composite or second sub-channel signal $S_2$ is suppressed carrier amplitude modulated on the second subcarrier which has the same frequency as the first subcarrier and is in quadrature phase relation to the first subcarrier, and the composite signal $S_3$ is suppressed carrier amplitude modulated on the third subcarrier which has a frequency twice that of the first subcarrier. However, the manner in which the modulation is effected need not be limited to that described above. By way of example, the composite signals $S_2$ and $S_3$ may be quadrature amplitude modulated on the third subcarrier (in which case, the second subcarrier may be omitted), or the composite signals $S_1$ and $S_2$ may be suppressed carrier quadrature amplitude modulated on the first and second subcarriers, as before, and the composite signal $S_3$ may be frequency modulated on the third subcarrier.

In any case, a four channel FM stereophonic composite signal which is usable in a decoder according to the invention is required to have an indication or pilot signal, as at $S_{p2}$, with a frequency three times that of the first pilot signal for indicating the four channel stereophonic broadcasting mode.

An embodiment of a decoder for four channel FM stereophonic composite signals $S(t)$ according to the invention will be now described with reference to FIG. 2. As shown, such decoder comprises a high frequency (RF) amplifier circuit 1 which amplifies a signal received by an antenna, a frequency converter circuit 2 which receives an output signal from the RF amplifier 1, an intermediate frequency (IF) amplifier 3 which receives an output signal from the converter circuit 2, and a frequency demodulator (FM demodulator) 4 which receives an output signal from the IF amplifier 3 and demodulates four channel FM stereophonic composite signals $S(t)$. The demodulated composite signal $S(t)$ is fed from demodulator 4 to a switching circuit 5 in which the composite signal $S(t)$ is switched with a 38 KHz switching or control signal $S_{38}$ shown in FIG. 3C and hereinafter further described, and a signal $S_L = (L_F+L_B)+(L_F-L_B).\sin 4\omega t$ and a signal $S_R=(R_F+R_B)+(R_F-R_B).\sin 4\omega t$ are demodulated thereby and provided at output terminals $5_L$ and $5_R$, respectively. The signals $S_L$ and $S_R$ are fed to switching circuits 6 and 7, respectively. The signals $S_L$ and $S_R$ are switched in the switching circuits 6 and 7, respectively, by means of a 76 KHz switching or control signal $S_{76}$ (which will be hereinafter described) and demodulated to provide discrete signals $L_F$ and $L_B$ and signals $R_F$ and $R_B$, respectively, which are delivered to terminals 11 and 12 and terminals 13 and 14, respectively.

In order to produce the switching or control signals $S_{38}$ and $S_{76}$ from the first pilot signal $S_{P1}$, a phase locked loop (PLL) 20 is provided. Such PLL 20 is shown to include a variable frequency or voltage controlled oscillator 21 which produces an oxcillation signal with an oscillation center frequency of, for example, 152 KHz, and applies the same to a ½ frequency divider circuit 22 which may be constituted by a flip-flop circuit. The frequency divider circuit 22 produces the pulse or switching signal $S_{76}$ with a frequency of 76 KHz which is, in turn, applied to a ½ frequency divider circuit 23 to provide the pulse or switching signal $S_{38}$ with a frequency of 38 KHz. The signal $S_{38}$ is fed to a ½ frequency divider circuit 24 which produces a pulse signal $S_{19}$ with a frequency of 19 KHz. The signal $S_{19}$ is fed to a phase comparator circuit 25 which also receives the composite signal $S(t)$ from FM demodulator 4 and compares the frequency and phase of the signal $S_{19}$ with that of the first pilot signal $S_{P1}$ in the composite signal $S(t)$. An output signal from the phase comparator 25 is applied through a low pass filter 26 to the voltage controlled oscillator 21 as a control signal for its oscillation frequency. Thus, the oscillation frequency of the voltage controlled oscillator 21 is controlled to maintain the pulse signal $S_{19}$ synchronized in phase and frequency with the first pilot signal $S_{P1}$ in the composite signal $S(t)$. As a result of the foregoing, the frequencies of the signals $S_{38}$ and $S_{76}$ are made to be 38 KHz and 76 KHz, respectively, and their phases are maintained in predetermined relation to that of the first pilot signal $S_{P1}$. The signal $S_{38}$ from divider circuit 23 is also applied to switching circuit 5 as its switching signal, and the signal $S_{76}$ from divider circuit 22 is also applied to a switching circuit 27 which, in the four channel stereophonic signal mode, applies the signal $S_{76}$ to the switching circuits 6 and 7 to cause the latter to demodulate the signals $L_F$, $L_B$, $R_F$ and $R_B$, as described above.

In the embodiment of FIG. 2, there is provided a circuit for discriminating whether or not a demodulated signal from demodulator 4 is the composite signal $S(t)$, that is, whether or not a four channel stereophonic broadcast transmission is being received. More specifically, as shown, the signal from demodulator 4 is applied through a phase shifter, for example, in the form of a high pass filter 33 consisting of a capacitor 31 and a resistor 32, to a switching circuit 34. The signals $S_{38}$ and $S_{19}$ from frequency dividers 23 and 24, respectively are applied to an AND-circuit 35 whose output signal $S_D$ is applied to the switching circuit 34 as its switching signal. An output signal from switching circuit 34 is applied to a low pass filter 36 for smoothing the same. A DC signal (component) $E_{DC}$ from low pass filter 36 is supplied through an amplifier 37 to a lamp 38 for illuminating the latter and thereby indicating the four channel stereophonic broadcasting mode, and also to switching circuit 27 as the control signal for the latter.

With the above circuit construction, due to the operation of phase comparator 25, the first pilot signal $S_{P1}$ and the signals $S_{19}$ and $S_{38}$ in PLL 20 have the phase relationships shown in FIGS. 3A to 3C and, accordingly, the output signal $S_D$ from AND-circuit 35 is as shown in FIG. 3D. Such output signal from AND-circuit 35 is expressed as follows:

$$S_D = \tfrac{1}{4} + 1/\pi.\sin\omega(t-\tau_o/4) + 1/\pi.\cos\omega(t-\tau_o/4) + 1/\pi.\sin 2\,\omega(t-\tau_o/4) + \tfrac{1}{3}\pi.\sin 3\,\omega(t-\tau_o/4) - \tfrac{1}{3}\pi.\cos 3\,\omega(t-\tau_o/4) + \qquad (2)$$

If $\tau_o$ is considered to be $2\pi/\omega$, so that $\sin\omega(t-\tau_o/4)$ becomes $\sin(\omega t-\pi/2)$ etc. then equation (2) can be rewritten as:

$$S_D = \tfrac{1}{4} + \sqrt{2}/\pi.\sin(\omega t-\pi/4) + 1/\pi.\sin(2\omega t-\pi) + \sqrt{2}/3\pi.\sin(3\omega t+\pi/4) + \qquad (3)$$

If the capacity of capacitor 31 is C and the resistance of resistor 32 is R, the transfer function $F(s)$ of filter 33 is expressed as follows:

$$F(s) = \frac{s\tau}{1+s\tau} \qquad (4)$$

in which $\tau = Cr$, that is, $\tau$ is the time constant for filter 33.

Therefore, the following expression is obtained:

$$F(j\omega) = \frac{1}{\sqrt{1+\frac{1}{\omega^2\tau^2}}}\exp\left(j\tan^{-1}\frac{1}{\omega\tau}\right) \qquad (5)$$

Thus, the DC signal $E_{DC}$ from low pass filter 36 is expressed as follows:

$$E_{DC} = \left\{\frac{P_1}{\sqrt{1+\frac{1}{\omega^2\tau^2}}}\sin\left(\omega\tau+\tan^{-1}\frac{1}{\omega\tau}\right) + \frac{P_2}{\sqrt{1+\frac{1}{3\omega^2\tau^2}}}\sin\left(3\omega t+\tan^{-1}\frac{1}{3\omega\tau}\right)\right\}S_D \qquad (6)$$

If equation (3) is substituted for $S_D$ in equation (6), the latter can be rewritten as:

$$E_{DC} = \frac{\sqrt{2}}{2\pi}\left\{\frac{P_1}{\sqrt{1+\frac{1}{\omega^2\tau^2}}}\cos\left(\tan^{-1}\frac{1}{\omega\tau}+\frac{\pi}{4}\right)\right\} + \frac{\sqrt{2}}{6\pi}\left\{\frac{P_2}{1+\frac{1}{(3\omega)^2\tau^2}}\cos\left(\tan^{-1}\frac{1}{3\omega\tau}-\frac{\pi}{4}\right)\right\} \qquad (7)$$

If the capacity C of capacitor 31 and the resistance R of resistor 32 are selected so that $\tau = 1/\omega$, then $\tan^{-1} 1/\omega\tau = \tau/4$ [rad] so that the first term in equation (7) becomes zero. Further, with $\tau = 1/\omega$, the expression $$1+\frac{1}{(3\omega)^2\tau^2}$$

in the second term of equation (7) becomes 1+1/9 or approximately 1. Therefore, the DC signal $E_{DC}$ can be approximated as:

$$E_{DC} \doteqdot \frac{\sqrt{2}P_2}{6\pi}\cos\left(\tan^{-1}\tfrac{1}{3}-\frac{\pi}{4}\right) \qquad (8)$$

Accordingly, it will be understood that the DC signal $E_{DC}$ is produced only when the second pilot signal $S_{P2}$ is present in the received broadcast transmission, and is not produced when such second pilot signal $S_{P2}$ is not present. In other words, when the DC signal $E_{DC}$ is produced, it indicates the existence of the second pilot signal $S_{P2}$, that is, it indicates that the demodulated signal from the demodulator 4 is the four channel FM stereophonic composite signal $S(t)$.

In the four channel FM stereophonic broadcasting mode, the DC signal $E_{DC}$ is applied through amplifier 37 to the lamp 38 for indicating that four channel FM stereophonic broadcast transmission is being received. Simultaneously, switching circuit 27 is switched by the DC signal $E_{DC}$ so that the signal $S_{76}$ from frequency divider 22 is applied through switching circuit 27 to the switching circuits 6 and 7 to cause the latter to demodulate the audio signals $L_F$,$L_B$,$R_F$ and $R_B$ by the switching procedure.

In the two channel stereophonic broadcasting mode, the second pilot signal $S_{P2}$ is not present and no DC signal $E_{DC}$ is produced, so that lamp 38 is not illuminated and the signal $S_{76}$ is not fed to switching circuits 6 and 7 by means of switching circuit 27 with the result that the left and right channel signals from switching circuit 5 are delivered to terminals 11 and 12 and to terminals 13 and 14, respectively.

It will be apparent that, with the decoder embodying this invention, as described above, four channel stereophonic reproduction is carried out in response to the detection of the second pilot signal $S_{P2}$ in the received broadcast transmission. Further, in the described circuit arrangement, the PLL 20 is fundamentally necessary for producing the switching signals $S_{38}$ and $S_{76}$ from the first pilot signal $S_{P1}$, and there is no need to provide an additional PLL or band pass filter for producing the second pilot signal $S_{P2}$.

When the decoder according to this invention includes the PLL 20 for the purposes indicated above, the circuit arrangement of the decoder is relatively simple in construction and inexpensive, and does not require adjustment or care after assembly as compared with the case where a band pass filter is employed.

However, it should be understood that means other than the PLL 20, for example, band pass filters, can be employed in the decoder accordding to this invention for providing the switching signals $S_{38}$ and $S_{76}$. Further, the signals $L_F$,$L_B$,$R_F$ and $R_B$ can be demodulated from the composite signal $S(t)$ by conventional techniques other than the disclosed switching technique or method when the DC signal $E_{DC}$ appears to indicate the presence of the second pilot signal $D_{P2}$ in the received broadcast transmission.

Although an illustrative embodiment of this invention and several modifications thereof have been described in detail herein, it is to be understood that the invention is not limited to that precise embodiment or the described modifications, and that a person skilled in the art may effect various changes and further modifications therein without departing from the scope or spirit of the invention as defined in the appended claims.

What is claimed is:

1. A decoder for four channel FM stereophonic composite signals which include a first pilot signal, a main channel signal, a first sub-channel signal suppressed carrier amplitude modulated on a first subcarrier having a frequency twice the frequency of said first pilot signal, a second sub-channel signal suppressed carrier amplitude modulated on a second subcarrier having the same frequency as said first subcarrier and having 90° phase difference with respect to said first subcarrier, a third sub-channel signal suppressed carrier amplitude modulated on a third subcarrier having a frequency twice that of the first subcarrier, and a second pilot signal indicative of four channel stereophonic signal broadcasting mode and having a frequency three times that of said first pilot signal, said decoder comprising: signal generating means for detecting said first pilot signal and for producing first and second control signals in predetermined phase relation to said first pilot signal with said first and second control signals having frequencies which are respective equal to, and twice the frequency of said first pilot signal, means responsive to said first and second control signals for producing a corresponding switching signal, and switching means receiving the four channel FM stereophonic composite signals and being operated by said switching signal for detecting said second pilot signal as an indication of the reception of four channel stereophonic broadcast transmissions.

2. A decoder according to claim 1; in which said main channel signal is $(L_F + L_B) + (R_F + R_B)$, said first sub-channel signal is $(L_F + L_B) - (R_F + R_B)$, and said second and third sub-channel signals are related such that said second sub-channel signal is $(L_F - L_B) + (R_F - R_B)$ when said third sub-channel signal is $(L_F - L_B) - (R_F - R_B)$ and said second sub-channel signal is $(L_F - L_B) - (R_F - R_B)$ when said third sub-channel signal is $(L_F - L_B) + (R_F - R_B)$ with $L_F$, $L_B$, $R_F$ $R_B$ being left front, left back, right front and right back audio signals, respectively; and further comprising demodulating means operable by at least said second control signal for obtaining said signals $L_F$, $L_B$, $R_F$ and $R_B$ as discrete audio signals from said four channel FM stereophonic composite signals.

3. A decoder according to claim 2; in which said demodulating means includes a first switching stage operable by said second control signal for demodulating said four channel FM stereophonic composite signals into first and second output signals, and a pair of second switching stages receiving said first and second output signals, respectively, from said first switching stage and being operable by a control signal with the frequency of said third subcarrier for demodulating said discrete audio signals $L_F$,$L_B$,$R_F$ and $R_B$ therefrom; said signal generating means includes means for producing a third control signal with a frequency twice that of said second control signal; and means responsive to the detection of said second pilot signal for applying said third control signal to said pair of second switching stages for operating the latter.

4. A decoder according to claim 1; in which said signal generating means is comprised of a phase locked loop including a variable frequency oscillator, frequency dividing means receiving the output of said variable frequency oscillator and dividing the same to provide said first and second control signals, and phase comparator means comparing the frequency and phase of said first pilot signal and of said first control signal and correspondingly controlling said variable frequency oscillator so that said first and second control signals are phase locked with said first pilot signal.

5. A decoder according to claim 4; in which said first and second control signals are trains of pulses occurring at the respective frequencies, and said means for combining said first and second control signals includes AND-circuit means receiving said trains of pulses constituting said first and second control signals and producing said switching signal as pulses occurring during the coincidence of said pulses of the first and second control signals.

6. A decoder according to claim 5; further comprising phase shifting means through which the four channel FM stereophonic composite signals are applied to said switching means so as to be adjusted in phase in respect to said pulses constitutting the switching signal.

7. A decoder according to claim 6; in which said phase shifting means includes a high pass filter having a time constant $\tau$ which is selected to satisfy the following equation:

$$\tan^{-1} \frac{1}{\omega \tau} = \frac{\pi}{4}$$

in which $\omega = 2\pi f$ and $f$ is said frequency of the first pilot signal.

8. A decoder according to claim 1; further comprising demodulating means having a first state for demodulating said four channel FM stereophonic composite signals and a second state for demodulating two channel stereophonic signals, and means for switching said demodulating means to said first state only in response to the detection by said switching means of said second pilot signal.

* * * * *